US007481229B2

(12) United States Patent
Habatjou

(10) Patent No.: US 7,481,229 B2
(45) Date of Patent: Jan. 27, 2009

(54) CASE WITH A SEALING ELEMENT

(75) Inventor: Jacques Habatjou, Cambrai (FR)

(73) Assignee: L'Oreal, Paris (FR)

( * ) Notice: Subject to any disclaimer, the term of this patent is extended or adjusted under 35 U.S.C. 154(b) by 432 days.

(21) Appl. No.: 10/698,521

(22) Filed: Nov. 3, 2003

(65) Prior Publication Data

US 2004/0139980 A1 Jul. 22, 2004

Related U.S. Application Data

(60) Provisional application No. 60/444,678, filed on Feb. 4, 2003.

(30) Foreign Application Priority Data

Nov. 6, 2002 (FR) ..... 02 13854
Nov. 15, 2002 (FR) ..... 02 14309

(51) Int. Cl.
*A45D 33/24* (2006.01)
*A45D 33/00* (2006.01)

(52) U.S. Cl. ..... 132/300; 132/293

(58) Field of Classification Search ..... 132/293–305; 215/235

See application file for complete search history.

(56) References Cited

U.S. PATENT DOCUMENTS 1,507,117 A * 9/1924 Johnson ..... 132/304
1,744,681 A * 1/1930 Callowhill et al. ..... 132/294
4,184,603 A * 1/1980 Hamilton, Sr. ..... 220/254.9
5,269,432 A * 12/1993 Beckertgis ..... 220/253
5,810,189 A * 9/1998 Baker ..... 220/257.2
5,988,185 A 11/1999 Gueret
2001/0017140 A1 8/2001 Petit
2005/0133475 A1* 6/2005 Goto et al. ..... 215/237
2005/0167388 A1* 8/2005 Bocola ..... 215/235

FOREIGN PATENT DOCUMENTS

| | | |
|---|---|---|
| EP | 0562965 | 9/1993 |
| FR | 1017922 | 12/1952 |
| FR | 2803993 | 7/2001 |
| JP | 59-115756 | 8/1984 |
| JP | 63-111810 | 7/1988 |
| JP | 63-129512 | 8/1988 |
| JP | 10-85036 | 4/1998 |
| JP | 10-276834 | 10/1998 |
| JP | 2001-292830 | 10/2001 |
| JP | 2002-179124 | 6/2002 |
| JP | 2002-315622 | 10/2002 |

* cited by examiner

*Primary Examiner*—Robyn Doan
(74) *Attorney, Agent, or Firm*—Oblon, Spivak, McClelland, Maier & Neustadt, P.C.

(57) ABSTRACT

A case incorporates a base part housing a reserve of product. A lid covers the base part. A sealing element can be arranged to close a space containing the product at least when the lid is closed. The sealing element can be supported by a pivot enabling it to rotate about geometrical axes of rotation.

53 Claims, 4 Drawing Sheets

CASE WITH A SEALING ELEMENT

CROSS-REFERENCE TO RELATED APPLICATIONS

This application claims priority to French Application Nos. 02 13854, filed Nov. 6, 2002 and 02 14309, filed Nov. 15, 2002 and to U.S. Provisional Application No. 60/444,678 filed Feb. 4, 2003, the entire content of all three applications is hereby incorporated by reference.

FIELD OF THE INVENTION

The present invention relates to cases designed to contain products, such as for example cosmetic or beauty care products.

BACKGROUND OF THE INVENTION

Discussion of Background

French patent application 2 803 993 proposes to fit a sealing element on a lid in a pivoting manner around a geometrical axis of rotation parallel to that of a hinge connecting the lid to the base part.

Document U.S. Pat. No. 5,988,185 describes a known packaging device incorporating a base part designed to hold a reserve of product and a lid fitted with a protective element. The protective element incorporates an elastically deformable element and is capable of covering in a detachable manner a free surface for taking the product from the product reserve. The protective element then bears elastically against the free surface of the product reserve.

SUMMARY OF THE INVENTION

There is a need to further improve the covering and/or sealing of the closure element of the conventional cases.

Thus, the object of the invention according to one preferred embodiment is a case including a base part holding a product reserve, a lid covering the base part, and a sealing element arranged to close in a leak tight manner a space containing the product, at least when the lid is closed. The sealing element can be supported by a pivot incorporating a ball joint enabling it to rotate about at least two mutually perpendicular geometrical axes of rotation.

The invention can provide a leak tight contact between the sealing element and a corresponding surface of the base part or of a cup seated in the base part. The invention can also accommodate differences of position of the cup in the base part or excess thicknesses caused by glue spots serving to attach the cup to the base part.

Advantageously, the pivot can include or be supported by a resiliently deformable part, which can further improve the sealing tightness. The sealing element can be attached to the device with the capability to move along a third axis perpendicular to the two mutually perpendicular axes.

The product reserve can be contained in a compartment defined in the base part, or in a cup, for example made of metal, supported by the base part. This cup can be glued to the base part. The compartment or cup can have a free edge, for example a rolled edge, against which the sealing element can bear.

The term "ball joint" is understood to mean any pivoting element allowing rotation around a point. This arrangement can increase mobility of the whole surface of the sealing element relative to the lid. The ball joint can, for example, involve the engagement of a head in a receptacle. Alternatively, the ball joint can also be obtained in a different manner, and can notably include an elastically deformable material, for example an elastomer. The portion of the pivot that is actually elastically deformable is then preferably placed at a distance from the edges of the cup such that a point of rotation can be defined at a distance from these edges. The ball joint formed at this point of rotation can then include a part forming an axis to connect the lid to the seal, this axis including a preferential point of flexure forming the point of rotation.

The sealing element can include a plate. This plate can be arranged to bear on the base part or the cup at least when the case is closed. This plate can be at least partially covered by an elastomer coating or include other sealing mechanisms, for example in the form of a flexible lip.

The product can contain at least one hydrocarbon-based solvent that is volatile at ambient temperature, for example hydrocarbon, for example isododecane.

The lid can be pivotably coupled to the base part. The sealing element can be attached to the lid. In an other embodiment, the sealing element can be attached to an element other than the lid, for example pivotably coupled to the base part.

This pivoting element can define, for example, a compartment to receive an applicator, notably a sponge.

According to an embodiment of the invention, it can be advantageous to make the case in such a manner as to create an initial lift effect to reduce the force needed to detach the sealing element from the surface against which it bears in a leak tight manner. This feature can be useful to reduce "suction-cup" effects due to a relatively low pressure in the space containing the product.

The sealing element can, for example, be made with an asymmetrical arrangement tending to avoid the "suction cup" effect on opening. For example, the sealing element can unevenly deform at its periphery, creating one or more areas of initial lift.

The sealing element can also be made so as to deform by bending about an axis on opening. The sealing element can, for example, be made with a plate having an asymmetrical feature, such as a variation in thickness.

The pivot can also be made so as to favor a pivoting or bending movement of the sealing element to facilitate opening. For example, the pivot can be asymmetrical relative to a third axis perpendicular to the geometrical axes of rotation.

A pivot support can also be made so as to favor such a movement.

BRIEF DESCRIPTION OF THE DRAWINGS

Other characteristics and advantages of the invention will become apparent from the following detailed description, particularly when considered in conjunction with the drawings in which.

DETAILED DESCRIPTION OF THE PREFERRED EMBODIMENTS

Figure 1:
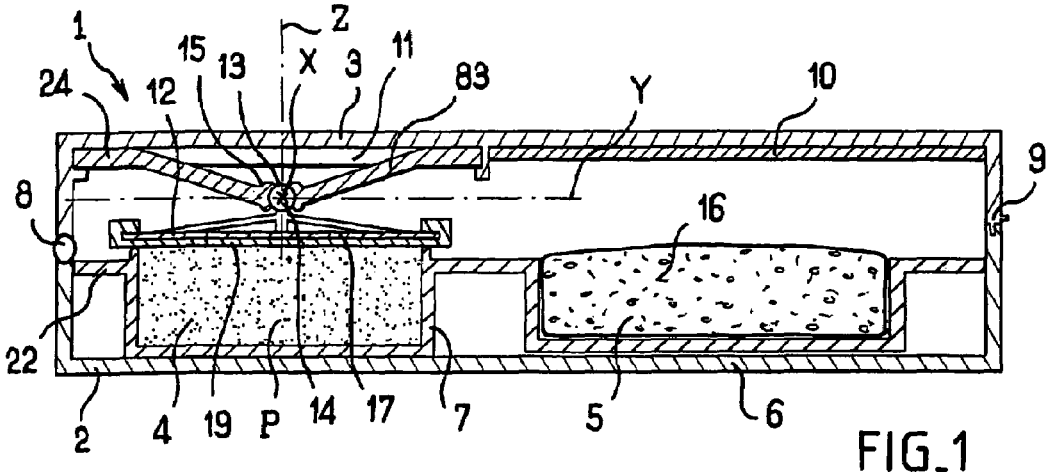
FIG. 1 shows a schematic partial cross-section of an example of a case made according to the invention.

FIG. 1 illustrates a case 1 including a base part 2 and a lid 3 pivoted relative to the base part by a hinge 8 about a geometrical axis of rotation perpendicular to the plane in FIG. 1.

The base part 2 includes a first compartment 4 which can contain a reserve of a product P, for example a foundation or a powder make-up, and a second compartment 5 designed to house an applicator 16 for application of the product P, for example a sponge.

In the example in question, the base part 2 comprises two elements, including an outer shell 6 and an inner element 7 fitted into the outer shell 6. The inner element 7 defines the first and second compartments 4 and 5 described above. The inner element 7 can be fixed in the outer shell 6 by any suitable mechanism, for example by gluing, soldering or snap-on fixing.

The lid 3 includes, at its end opposite the pivot 8, a closure 9 incorporating, for example, a lug capable of latching onto a counterpart projection on the base part 2, a mirror 10 and a supporting element 11 for an element 12. The element 12 is designed to cover the compartment 4 containing the product P when the case 1 is closed. In a preferred embodiment, the element 12 seals the compartment 4 in a leak tight manner in the closed lid position. This feature can be useful, for example, to avoid evaporation of a volatile solvent which may be contained in the product P.

According to a preferred embodiment of the invention, the element 12 is connected to the support element 11 by a pivot 13. The pivot 13 allows the element 12 to pivot about an axis passing through the pivot 13. In a preferred embodiment, the element 12 rotates about at least two mutually perpendicular geometrical axes of rotation, such as an axis X parallel to the axis of hinge axis Y perpendicular to that of hinge 8 and contained in the plane of FIG. 1. In another embodiment, the element 12 pivots about at least one axis, e.g. axis Y, which makes an angle with the axis of the hinge 8.

In the illustrated example, the pivot 13 includes a ball joint 14 in a receptacle or cage 15. The ball joint 14 can rotate about the axes X and Y within the cage 15. The sealing element 12 includes a plate 17. The ball joint 14 can be made, for example, in one piece by plastic injection molding with the plate 17 of the sealing element 12. The cage 15 can be made, for example, in one piece with the support element 11.

Figure 2:
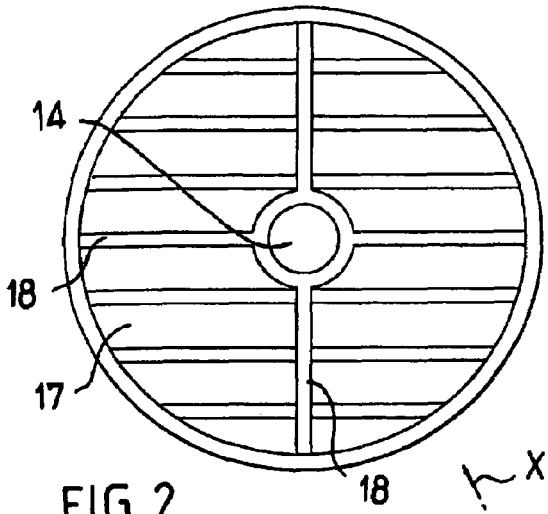
FIG. 2 shows a top view, in isolation, of the sealing element of the case in FIG. 1.

As illustrated in FIG. 2, the plate 17 can be made with stiffening ribs 18 on its opposite surface from the product P. The surface of the plate 17 facing towards the product P can be covered in its entirety or around its periphery only by an elastomer coating 19. The coating 19 can provide a leak tight contact by bearing, in the example shown, against the edge of a rib 22 surrounding the compartment 4.

Figure 3:
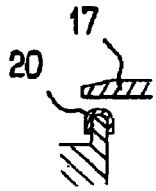
FIG. 3 shows a schematic and partial view of an alternative embodiment wherein the rim of the compartment containing the product includes a seal against which the sealing element can bear.

As a variant illustrated in FIG. 3, the plate 17 need not be covered with elastomer and the base part can include a seal 20, for example a molded elastomer seal or fitted sealing lip against which the plate 17 bears when the case 1 is closed. In another variant (not shown), the sealing element 12 can also be made with a sealing lip arranged to engage in a leak tight manner with a counterpart surface on the base part.

As shown in FIG. 1, the support element 11 can be made to enable the cage 15 to move relative to the lid 3 on a geometrical axis Z perpendicular to the axes X and Y. The support element 11 can, for example, be made with arms 83 having a degree of flexibility, connecting the cage 15 to the upper part 24 of the support element 11 by which the latter is attached to the lid 3.

When the case 1 is closed, the element 12 can bear against the rim of the compartment 4. In a preferred embodiment, the element 12 closes the compartment 4 in a leak tight manner. The ability of the sealing element 12 to pivot relative to the lid 3 about the axes X and Y can reduce the risk of non-leak tight application of the sealing element 12 against the counterpart surface of the base part 2, and can allow for any differences in positioning of the inner element 7 inside the outer shell 6.

In the example of FIG. 1, the product P is placed directly in the compartment 4 defined by the inner element 7. The scope of the present invention is not exceeded when the product P is contained in a cup 50. The cup 50 can be made of metal, for example, fitted onto the base part 2. The cup 50 can be, for example, glued to the base part 2, as shown in FIGS. 4 and 5.

Rather than being pivoted on a support element attached to the lid, the sealing element 12 can pivot directly on the lid 3 or on an intermediate element 60 that is mobile relative to the lid 3.

Figure 4:
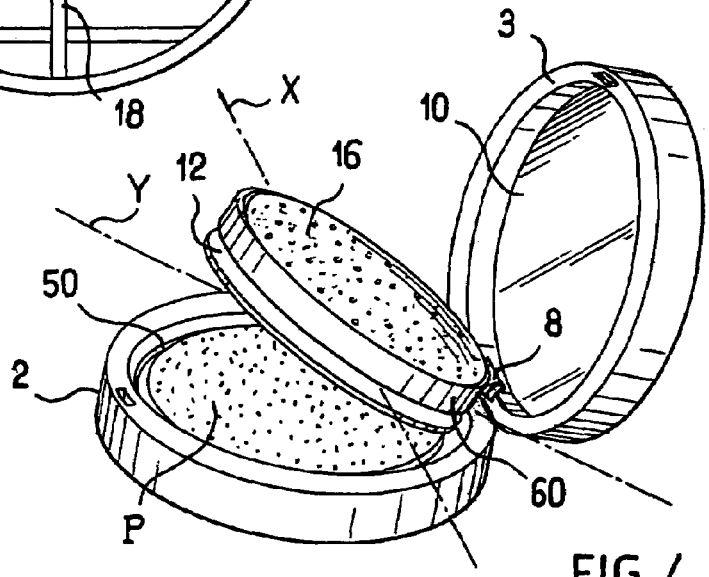
FIG. 4 is a schematic view, in perspective, of an alternative embodiment wherein the sealing element is mobile relative to the lid.
Figure 5:
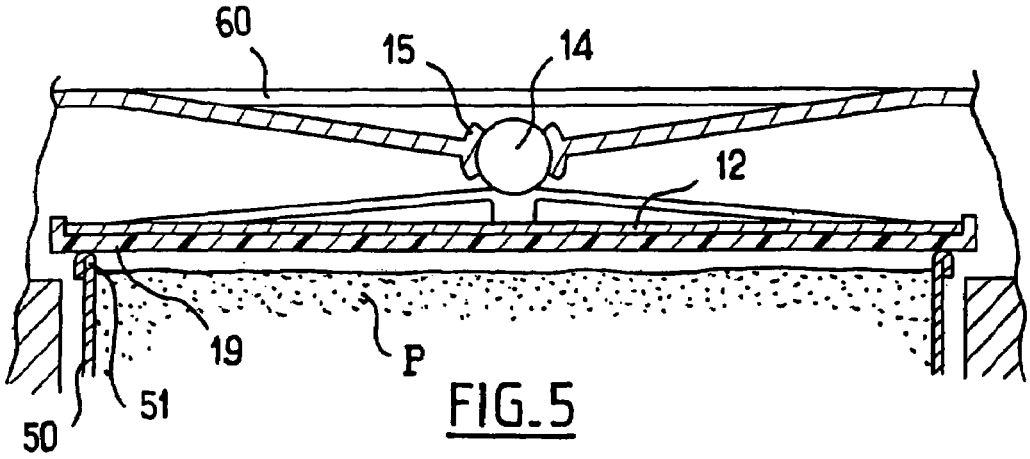
FIGS. 5 and 6 are schematic illustrations of embodiments wherein the product is contained in a cup fitted into a compartment in the base part of the case.

In the example of FIG. 4, the intermediate element 60 pivots with respect to the base part 2. On the side facing the lid 3, the intermediate element 60 can define a compartment to receive an applicator 16. The applicator 16 can be a sponge, for example.

In FIG. 4, the pivot connecting the sealing element 12 to the intermediate element 60 is not apparent. This pivot can be made, for example, with a ball joint 14 as illustrated in FIG. 5. The sealing element 12 can bear against the upper edge 51 of the cup 50. The upper edge 51 can be rolled so as not to damage the coating 19.

The pivoting action of the sealing element 12 relative to the intermediate element 60 can accommodate not only discrepancies attributable to the position of the cup 50 in its compartment but also any variations in the level of the upper edge 51 of the cup attributable to the thickness of the glue spots which may be used to attached the latter to the base part 2.

Figure 6:
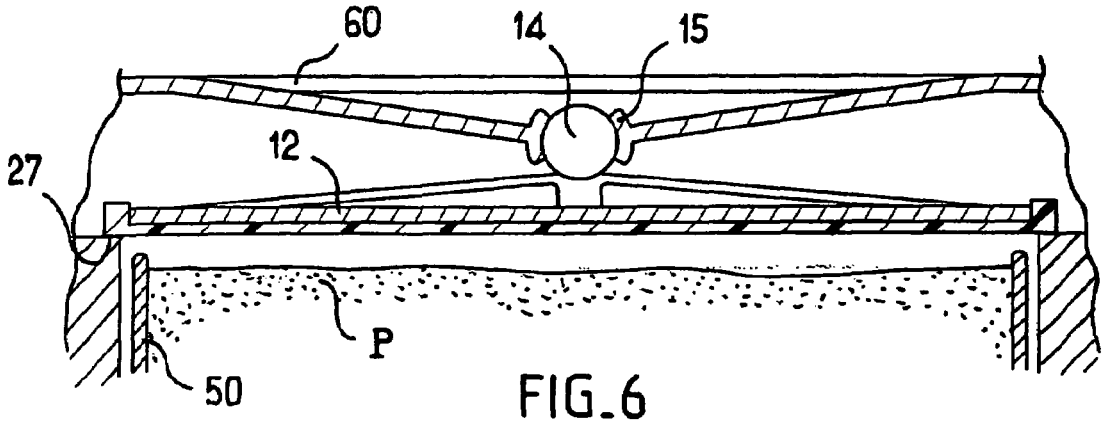

As a variant, the sealing element 12 can bear against the rim 27 of the compartment receiving the cup 50, as illustrated in FIG. 6.

Whether the sealing element 12 is integral with the lid 3 or with an intermediate element 60 mobile relative to the lid, the pivoting action can be achieved other than by a ball joint incorporating a head 14 engaged in a cage 15.

Figure 7:
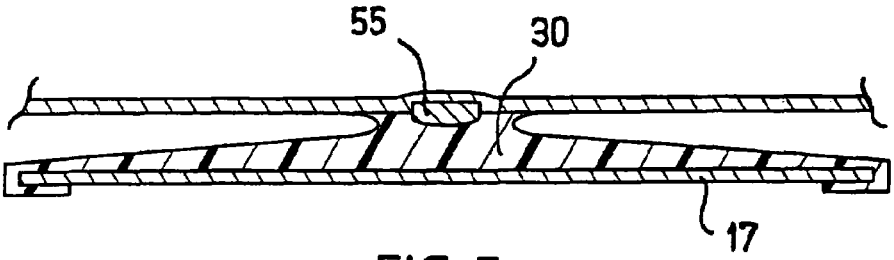
FIGS. 7 and 8 illustrate alternative embodiments of the pivot.

By way of example, FIG. 7 illustrates a pivot made in an elastomer material 30 molded onto the plate 17 of the sealing element 12. As seen in FIG. 7, the material of the pivot 30 can, if desired, extend to the edge of the plate 17 and overlap slightly onto the inner face. This overlap feature can replace the leak tight covering 19 previously described.

The pivot 30 can be fixed, for example, by glue 55 to the lid 3 or to the intermediate element 60. As a variant, the material of the pivot 30 can be molded both onto the plate 17 and onto the lid 3 or a support element attached to the latter or the intermediate element 60, thus serving to attach the sealing element to the rest of the case.

Figure 8:
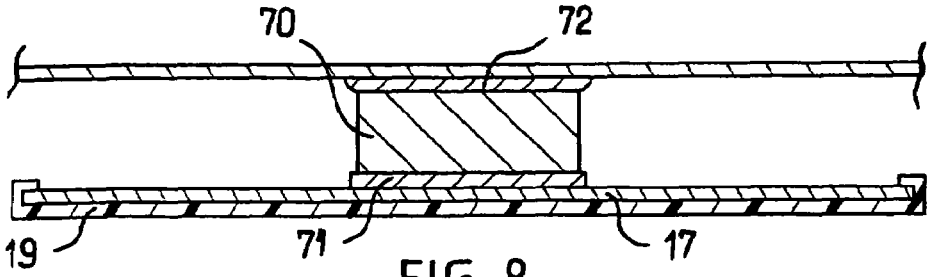

As illustrated in FIG. 8, the pivot can also be made by a block 70 of elastically deformable material, for example, a foam. The latter can be attached, for example, by gluing its principal opposing surfaces 71 and 72 respectively to the plate 17 and to a support element or to the lid or to an intermediate element mobile relative to the lid.

In the case where the pivot is made of an elastomer material 30, or where the pivot is made using a block 70 of a resiliently deformable material, the pivot can be formed around a point of rotation at a distance from the free edges of the sealing element. The pivot is obtained by local shrinkage of the elastomer material or a block of elastically deformable material of transverse cross-section considerably smaller than the cross-section of the sealing element. The point of rotation is, for example, defined on the axis Z.

As it bears in a leak tight manner on its compartment, the sealing element can be difficult to open by virtue of the "suction-cup" effect. To mitigate this effect, the case can be made in a manner such that the sealing element tends to detach preferentially in a limited area on its periphery. In other words, the sealing element and/or its compartment and/or the pivot and/or the pivot support can be made so as to create an initial lift effect.

Figure 9:
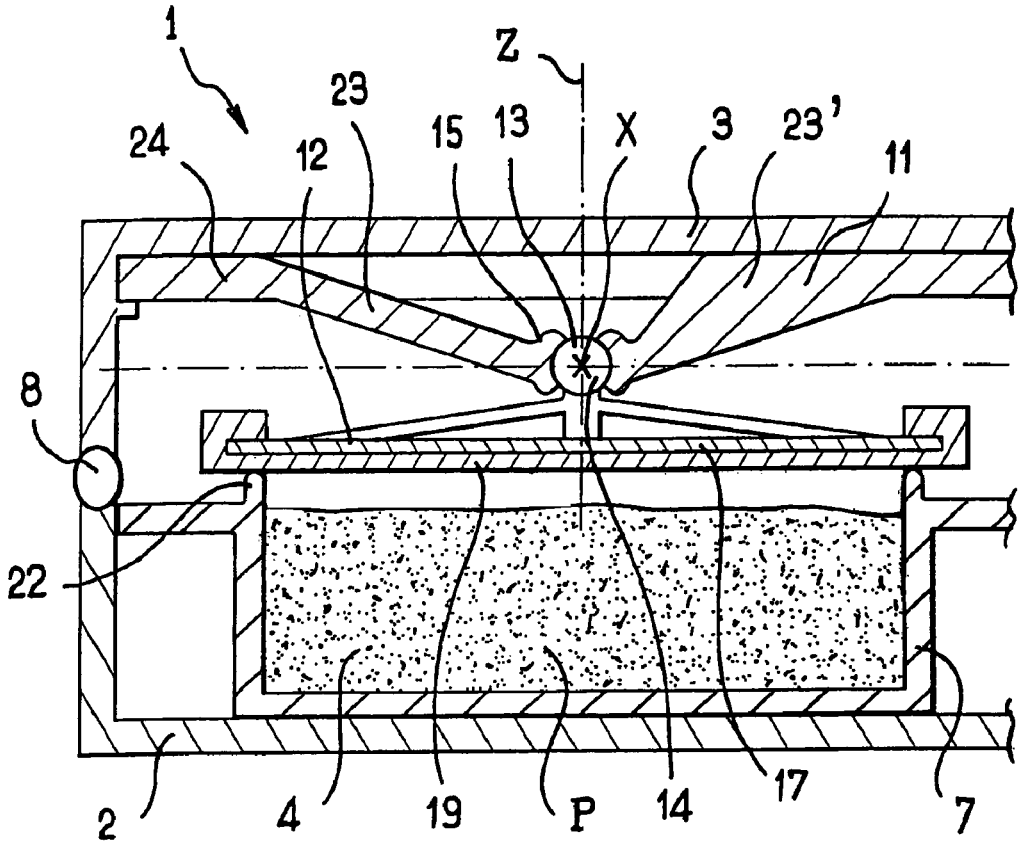
FIGS. 9 to 12 illustrate alternative embodiments designed to facilitate opening in case of a relatively low pressure in the space containing the product.

As illustrated in FIG. 9, the pivot support element 11 can include one or more arms 23' made stiffer by having, for example, a larger circumferential extent or by being thicker so that torque is exerted on the sealing element on opening, tending to facilitate its detachment.

Figure 10:
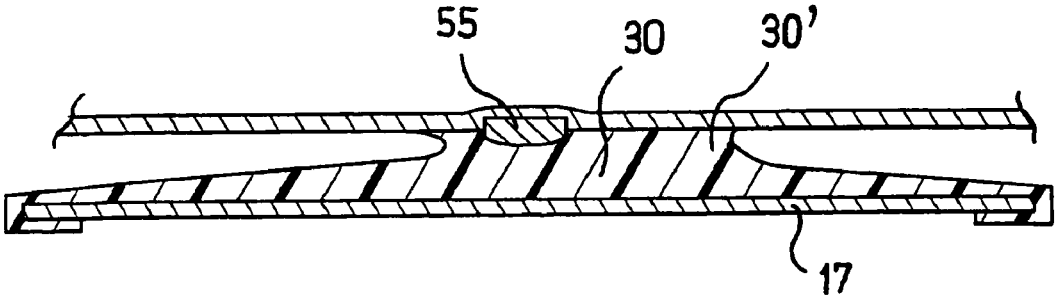
Figure 11:
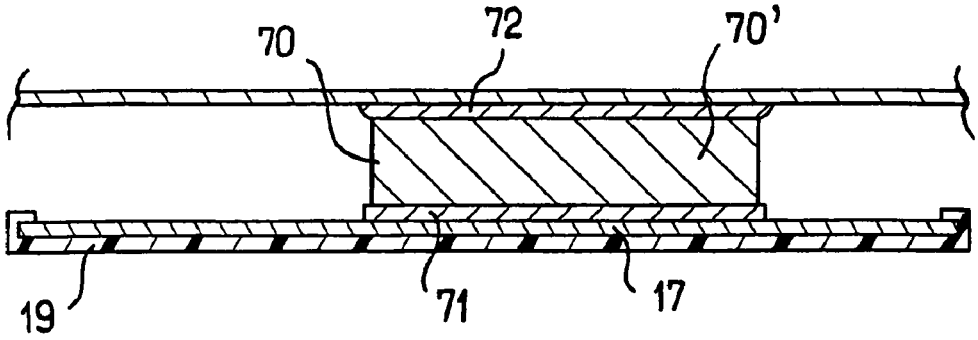

As illustrated in FIG. 10, the pivot 30 can include a part 30' set off-centre so as to create an asymmetrical stress distribution on the sealing element on opening. Similarly, the pivot 70 of FIG. 8 include an off-centre part 70', as illustrated in FIG. 11.

Figure 12:
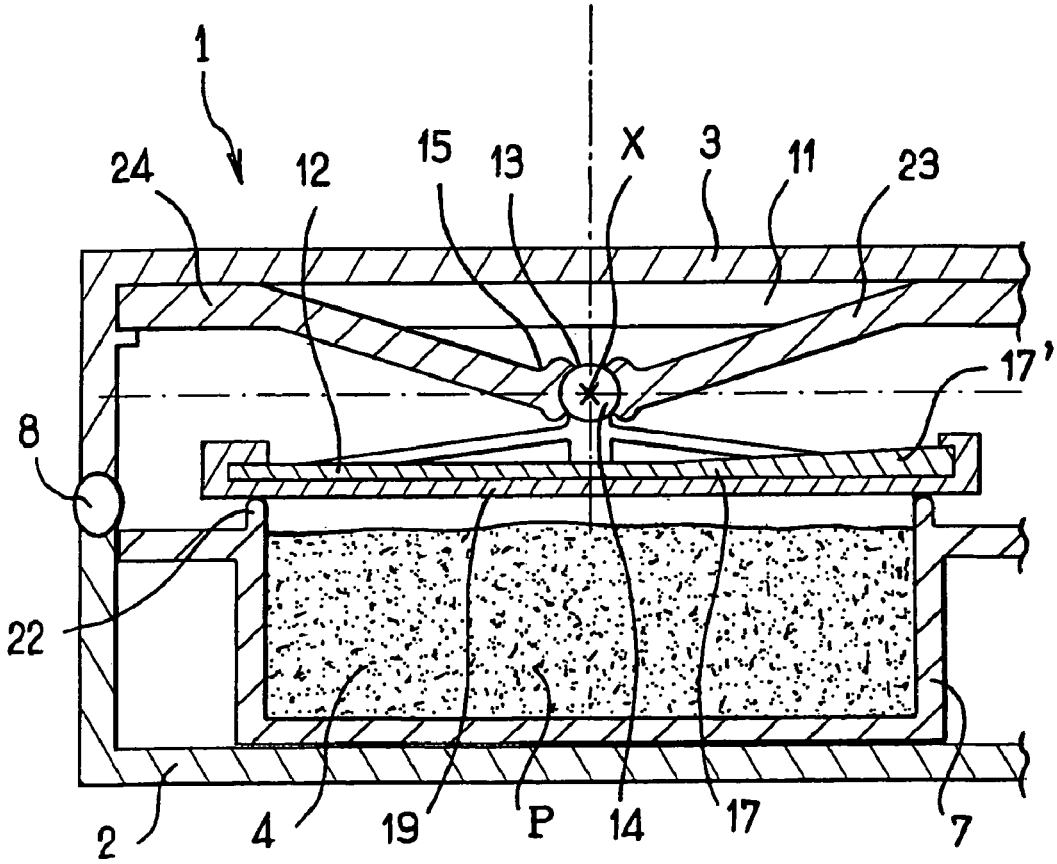

As shown in FIG. 12, the sealing element can include a more flexible area capable of deforming to a greater extent on opening and facilitating detachment of the sealing element. In the example of FIG. 12, the plate 17 includes a portion 17' of greater thickness such that the separation force transmitted by the pivot is distributed in a non-uniform manner to the periphery of the sealing element, thereby creating an initial lift effect.

The invention is not limited to the exemplary embodiments described above. It is notably possible to combine different features of the various embodiments here described.

Throughout the description, including the claims, the expression "including one" should be understood to be synonymous with "including at least one", unless otherwise specified.

Obviously, numerous modifications and variations of the present invention are possible in light of the above teachings. It is therefore to be understood that, within the scope of the appended claims, the invention can be practiced otherwise than as specifically described herein.

What is claimed as new and desired to be secured by Letters Patent of the United States is:

1. A case comprising:

a base part holding a reserve of product;

a lid covering the base part; and a sealing element arranged to close in a leak tight manner a space containing the product, at least when the lid is closed, wherein the sealing element is supported by a pivot incorporating a ball joint so that said sealing element is rotatable about at least two mutually perpendicular geometrical axes of rotation, wherein the pivot is supported by a first element, said first element being pivotable with respect to the base part about a pivot axis.

2. The case according to claim 1, wherein the pivot includes a resiliently deformable part.

3. The case according to claim 1, wherein the pivot is supported by at least one resiliently deformable element.

4. The case according to claim 1, further comprising a cup supported by the base part and containing said reserve of product.

5. The case according to claim 4, wherein the cup is glued onto the base part.

6. The case according to claim 4, wherein said cup is made of metal.

7. The case according to claim 4, wherein the cup has a free edge against which the sealing element can bear.

8. The case according to claim 1, wherein the sealing element is arranged to bear on the base part at least when the case is closed.

9. The case according to claim 1, wherein the sealing element includes a plate.

10. The case according to claim 1, wherein the lid is pivotable with respect to the base part.

11. The case according to claim 1, wherein the sealing element is attached to the lid.

12. The case according to claim 1, wherein the sealing element is not the lid.

13. The case according to claim 12, wherein the pivotable element defines a compartment to receive an applicator.

14. The case according to claim 13, wherein the applicator is a sponge.

15. The case according to claim 1, wherein the sealing element is movable along an axis perpendicular to said two axes.

16. The case according to claim 1, wherein said sealing element provides an initial lift effect to reduce a force needed to detach the sealing element from a surface against which said sealing element bears in a leak tight manner.

17. The case according to claim 1, wherein the pivot favors a movement of the sealing element.

18. The case according to claim 1, wherein the pivot is asymmetrical relative to a third axis perpendicular to said two axes.

19. The case according to claim 1, wherein the pivot is supported by a support element.

20. The case according to claim 1, wherein the sealing element includes a plate having an asymmetrical feature, allowing uneven deformation of the sealing element at a periphery so as to create at least one area of initial lift.

21. The case according to claim 20, wherein said plate has a variation in thickness.

22. The case according to claim 1, wherein said product contains at least one solvent that is volatile at ambient temperature.

23. The case according to claim 22, wherein said solvent is isododecane.

24. The case according to claim 1, wherein the sealing element is movable from an open position to a closed position by pivoting the first element about the pivot axis, wherein said space containing the product is not closed in said leak tight manner when the sealing element is in the open position and said space containing the product is closed in said leak tight manner when the sealing element is in the closed position.

25. The case according to claim 1, wherein said sealing element is configured to prevent evaporation of said product in said closed position.

26. The case according to claim 1, wherein said sealing element is coupled to said element such that the space is always closed by the sealing element when said lid is closed.

27. The case according to claim 1, wherein said lid is pivoted to said base part by a hinge about said pivot axis.

28. The case according to claim 1, wherein said pivot includes said ball joint in a receptacle, and wherein said receptacle is attached to said lid via arms.

29. The case according to claim 28, wherein said arms are flexible.

30. The case according to claim 1, wherein said ball joint is positioned entirely above said sealing element such that said sealing element is rotatable about said at least two mutually perpendicular geometrical axes of rotation at a point of rotation located at a distance from said sealing element between said lid and said sealing element.

31. The case according to claim 1, wherein said sealing element does not contact said lid when said sealing element seals said space containing the product and when the lid is closed.

32. The case according to claim 1, wherein said sealing element includes a plate that seals said space containing the product when the lid is closed, and wherein said ball joint separates said plate from said lid so that said plate does not contact said lid when said plate seals said space containing the product and when the lid is closed.

33. The case according to claim 32, wherein said plate is free of holes thereby providing a suction-cup effect inside said space containing the product when the lid is closed.

34. The case according to claim 1, further comprising a cup defining said space containing the product, wherein said cup and said pivot are two distinct pieces of different materials.

35. The case according to claim 34, wherein said cup is of metal and said pivot is of an elastomer material.

36. A case comprising:

a base with a first compartment and a second compartment;

a lid coupled to said base and movable to a closed lid position in which said lid covers said base; and a cover member with a central portion and a peripheral portion, said cover member being movable from an open position, in which said first and second compartments are not covered by said cover member, to a closed position, in which said first compartment is covered by said cover member and said second compartment is not covered by said cover member, said cover member being coupled to said lid in said open position via said central portion of said cover member so that said peripheral portion is pivotable about at least one axis passing through said central portion in said open position, and said cover member being coupled to said lid so that said cover member is always in said closed position when said lid is in said closed lid position, wherein said central portion comprises a ball joint in a receptacle, wherein said ball joint is positioned entirely above said peripheral portion such that said peripheral portion is pivotable about said at least one axis at a point of rotation located at a distance from said peripheral portion between said lid and said peripheral portion.

37. The case according to claim 36, wherein in said closed position, said peripheral portion of said cover member bears against an edge of said first compartment so as to seal said first compartment.

38. The case according to claim 37, wherein said peripheral portion includes a plate that seals said first compartment in said closed position, and wherein said ball joint separates said plate from said lid so that said plate does not contact said lid when said plate seals said first compartment in said closed position.

39. The case according to claim 38, wherein said plate if free of holes thereby providing a suction-cup effect inside said first compartment in said closed position.

40. The case according to claim 36, wherein in said closed lid position, said second compartment is covered by said lid.

41. The case according to claim 36, wherein said case further comprises a product in said first compartment.

42. The case according to claim 41, wherein said second compartment is free of said product.

43. The case according to claim 41, wherein said second compartment comprises an applicator for said product.

44. The case according to claim 41, wherein said product is a cosmetic product.

45. The case according to claim 41, wherein said product is a beauty care product.

46. The case according to claim 36, wherein said cover member is asymmetric with respect to an axis of rotation of said cover member.

47. The case according to claim 36, further comprising a resiliently deformable part between the central portion and said lid.

48. A case comprising:

a base with a first compartment and a second compartment;

a lid coupled to said base and movable to a closed lid position in which said lid covers said base; and a cover member with a central portion and a peripheral portion, said cover member being movable from an open position, in which said first and second compartments are not covered by said cover member, to a closed position, in which said first compartment is covered by said cover member and said second compartment is not covered by said cover member, said cover member being coupled to said lid in said open position via said central portion of said cover member so that said peripheral portion is pivotable about at least one axis passing through said central portion in said open position, wherein said central portion comprises a ball joint in a receptacle, and wherein said receptacle is attached to said lid via arms, wherein, in said closed position, said peripheral portion of said cover member bears against an edge of said first compartment so as to seal said first compartment, and wherein said ball joint separates said peripheral portion from said lid so that said peripheral portion does not contact said lid when said peripheral portion seals said first compartment in said closed position.

49. The case according to claim 48, wherein said arms are flexible.

50. A case comprising:

a base part holding a reserve of product;

a lid covering the base part; and a sealing element arranged to close in a leak tight manner a space containing the product, at least when the lid is closed, wherein the sealing element is supported by a pivot incorporating a ball joint so that said sealing element is rotatable around said ball joint about at least two mutually perpendicular geometrical axes of rotation, wherein said pivot includes said ball joint in a receptacle, and wherein said receptacle is attached to said lid via arms.

51. A case comprising:

a base part holding a reserve of product;

a lid covering the base part; and a sealing element arranged to close in a leak tight manner a space containing the product, at least when the lid is closed, wherein the sealing element is supported by a pivot so that said sealing element is rotatable around said pivot about at least two mutually perpendicular axes of rotation, wherein the pivot includes a ball joint in a receptacle, a block of elastically deformable material that includes a transverse cross-section that is smaller than a transverse cross-section of the sealing member, or an elastomer material having a local shrinkage defined in an axis (Z) perpendicular to the two at least mutually perpendicular axes of rotation.

52. The case according to claim 51, wherein the transverse cross-section of the sealing member is at least twice as large as the transverse cross-section of the block of elastically deformable material.

53. The case according to claim 51, wherein the transverse cross-section of the sealing member is at least three times as large as the transverse cross-section of the block of elastically deformable material.

* * * * *

UNITED STATES PATENT AND TRADEMARK OFFICE

CERTIFICATE OF CORRECTION

PATENT NO. : 7,481,229 B2
APPLICATION NO. : 10/698521
DATED : January 27, 2009
INVENTOR(S) : Jacques Habatjou It is certified that error appears in the above-identified patent and that said Letters Patent is hereby corrected as shown below:

In column 6, line 16, change “sealing” to --first--.

In column 7, line 61, change “if” to --is--.

Signed and Sealed this

Sixteenth Day of June, 2009

JOHN DOLL
*Acting Director of the United States Patent and Trademark Office*